US008827078B2

(12) United States Patent
Doemel et al.

(10) Patent No.: US 8,827,078 B2
(45) Date of Patent: Sep. 9, 2014

(54) CONTAINER WITH KICK-BACK

(76) Inventors: Jana Doemel, Oshkosh, WI (US); Brad Schultz, Greenville, WI (US); Bevon Dormer, Hershey, PA (US)

( * ) Notice: Subject to any disclaimer, the term of this patent is extended or adjusted under 35 U.S.C. 154(b) by 135 days.

(21) Appl. No.: 13/457,835

(22) Filed: Apr. 27, 2012

(65) Prior Publication Data

US 2013/0020230 A1 Jan. 24, 2013

Related U.S. Application Data

(60) Provisional application No. 61/479,717, filed on Apr. 27, 2011.

(51) Int. Cl.

| | |
|---|---|
| ***B65D 5/42*** | (2006.01) |
| ***B65D 5/54*** | (2006.01) |
| ***B65D 5/02*** | (2006.01) |
| ***B65D 77/04*** | (2006.01) |
| ***B65D 5/16*** | (2006.01) |

(52) U.S. Cl.

CPC ..... *B65D 77/0413* (2013.01); *B65D 5/542* (2013.01); *B65D 5/02* (2013.01); *B65D 5/16* (2013.01)

USPC ..... 206/774; 229/117.28; 229/120.13

(58) Field of Classification Search

CPC ..... B65D 5/5405

USPC ..... 206/778, 783, 585, 593; 229/117.27, 229/117.28, 120.13, 242

See application file for complete search history.

(56) References Cited

U.S. PATENT DOCUMENTS

| | | | | | |
|---|---|---|---|---|---|
| 1,827,008 | A | | 10/1931 | Huckel | |
| 1,912,847 | A | | 6/1933 | Earl | |
| 1,916,230 | A | * | 7/1933 | Murray | 119/52.4 |
| 1,992,373 | A | | 2/1935 | Johnson | |
| 2,018,707 | A | | 10/1935 | Daller | |
| D104,437 | S | | 5/1937 | Bulman | |
| 2,305,087 | A | * | 12/1942 | Keller | 229/120.13 |
| 2,339,656 | A | | 1/1944 | Shina | |
| D146,386 | S | | 2/1947 | Shield | |
| D153,188 | S | | 3/1949 | Stensgaard | |
| D158,775 | S | | 5/1950 | Malkin | |
| D158,776 | S | | 5/1950 | Malkin | |
| 2,706,066 | A | | 4/1955 | Wells | |
| 2,798,685 | A | | 7/1957 | Mooney | |
| 2,807,402 | A | * | 9/1957 | Nelbach | 206/589 |
| 2,944,555 | A | | 7/1960 | Peel et al. | |
| 2,975,890 | A | | 3/1961 | Block | |
| 3,026,015 | A | | 3/1962 | Severn | |

(Continued)

FOREIGN PATENT DOCUMENTS

| | | |
|---|---|---|
| EP | 0629557 A1 | 12/1994 |
| JP | 06278746 | 10/1994 |

OTHER PUBLICATIONS

LeBlanc, Rick; "Limits on Export Pallets Creating Corrugated Window of Opportunity; Corrugated Pallet Suppliers Experiencing Renewed Interest for Export, Domestic Markets"; http://www.palletenterprise.com/articledatabase/view.asp?articleID=648; 7 pages; Apr. 1, 2002.

"Solid Wood Packing Materials to Argentina"; http://www.corrugatedprices.com/pallets/swang.html; 2 pages; Feb. 5, 2002.

*Primary Examiner* — David Fidei

(74) *Attorney, Agent, or Firm* — Ungaretti & Harris LLP

(57) ABSTRACT

A container or box formed from an inner carton and an outer carton. The cartons can be formed from paperboard or a corrugated material.

20 Claims, 5 Drawing Sheets

(56) References Cited

U.S. PATENT DOCUMENTS

| | | | | |
|---|---|---|---|---|
| 3,026,078 | A | 3/1962 | Simkins | |
| 3,058,646 | A | 10/1962 | Guyer | |
| 3,161,341 | A | 12/1964 | Farquhar | |
| D204,434 | S | 4/1966 | Kingsford | |
| 3,480,196 | A | 11/1969 | Simas | |
| 3,690,118 | A | 9/1972 | Rainwater | |
| 3,696,990 | A | 10/1972 | Dewhurst | |
| 3,730,417 | A | 5/1973 | Lawson | |
| 3,879,053 | A | 4/1975 | Chvala | |
| 3,886,348 | A | 5/1975 | Jonathan et al. | |
| 3,944,128 | A | 3/1976 | Hogan | |
| D239,805 | S | 5/1976 | South | |
| 4,004,691 | A | 1/1977 | Wihksne | |
| D244,117 | S | 4/1977 | Naylor | |
| 4,085,847 | A | 4/1978 | Jacalone | |
| 4,099,813 | A | 7/1978 | Olivan | |
| 4,171,741 | A | 10/1979 | Fish | |
| 4,283,000 | A | 8/1981 | White | |
| 4,375,874 | A | 3/1983 | Leotta et al. | |
| 4,376,558 | A | 3/1983 | Bandar | |
| 4,399,157 | A * | 8/1983 | Caporaso | 426/108 |
| 4,503,973 | A | 3/1985 | Andersson | |
| D278,493 | S | 4/1985 | Brescia et al. | |
| 4,602,735 | A | 7/1986 | Aaron | |
| 4,610,355 | A | 9/1986 | Maurer | |
| 4,658,984 | A | 4/1987 | Brunner | |
| 4,688,716 | A | 8/1987 | Winterling | |
| D292,659 | S | 11/1987 | Svezia et al. | |
| D293,520 | S | 1/1988 | Ovitz, III | |
| 4,722,473 | A | 2/1988 | Sandrini et al. | |
| D294,908 | S | 3/1988 | Childress | |
| 4,765,492 | A | 8/1988 | Howard et al. | |
| 4,793,664 | A | 12/1988 | Jackson | |
| 4,826,265 | A | 5/1989 | Hockenberry | |
| 4,850,284 | A | 7/1989 | DeGroot et al. | |
| 4,852,756 | A | 8/1989 | Holladay | |
| 4,863,024 | A | 9/1989 | Booth | |
| 4,871,067 | A | 10/1989 | Valenti | |
| 4,877,137 | A | 10/1989 | Govang et al. | |
| 4,911,084 | A | 3/1990 | Sato et al. | |
| 4,936,470 | A | 6/1990 | Prindle | |
| D321,100 | S | 10/1991 | Dorrell | |
| D321,295 | S | 11/1991 | Nuebler | |
| D321,615 | S | 11/1991 | Lavine et al. | |
| 5,067,418 | A | 11/1991 | Carter | |
| 5,119,740 | A | 6/1992 | Carter | |
| 5,176,265 | A | 1/1993 | Bennett | |
| D332,883 | S | 2/1993 | Staude | |
| 5,195,440 | A | 3/1993 | Gottlieb | |
| 5,259,631 | A | 11/1993 | Brande | |
| 5,269,219 | A | 12/1993 | Juvik-Woods | |
| 5,272,990 | A | 12/1993 | Carter | |
| D349,202 | S | 8/1994 | Eliadis et al. | |
| D351,076 | S | 10/1994 | Eliadis et al. | |
| 5,357,875 | A | 10/1994 | Winebarger et al. | |
| 5,388,531 | A | 2/1995 | Crews et al. | |
| 5,413,053 | A | 5/1995 | Vannatta | |
| 5,427,019 | A | 6/1995 | Moorman | |
| D362,768 | S | 10/1995 | Lechleiter et al. | |
| D363,840 | S | 11/1995 | Weshler | |
| 5,465,672 | A | 11/1995 | Boyse et al. | |
| 5,487,344 | A | 1/1996 | Hutchison | |
| 5,487,345 | A | 1/1996 | Winebarger et al. | |
| D369,035 | S | 4/1996 | Potter | |
| D369,043 | S | 4/1996 | Parker | |
| 5,520,120 | A | 5/1996 | Badger | |
| 5,528,994 | A | 6/1996 | Iseli | |
| 5,540,536 | A | 7/1996 | Hoedl | |
| 5,543,205 | A | 8/1996 | Liebel | |
| 5,590,606 | A | 1/1997 | Crews et al. | |
| 5,603,258 | A | 2/1997 | Besaw | |
| 5,622,306 | A | 4/1997 | Grigsby et al. | |
| 5,672,412 | A | 9/1997 | Phares et al. | |
| 5,685,234 | A | 11/1997 | Grigsby et al. | |
| D388,905 | S | 1/1998 | Wells | |
| 5,706,953 | A | 1/1998 | Polvere | |
| 5,711,423 | A | 1/1998 | Fuller, Jr. | |
| D395,534 | S | 6/1998 | Besaw | |
| 5,762,213 | A | 6/1998 | Heneveld, Sr. | |
| 5,791,487 | A | 8/1998 | Dixon | |
| 5,794,542 | A | 8/1998 | Besaw | |
| 5,797,499 | A | 8/1998 | Pinco | |
| D398,461 | S | 9/1998 | Baluk | |
| D398,462 | S | 9/1998 | Baluk et al. | |
| 5,809,903 | A | 9/1998 | Young, Jr. | |
| 5,816,172 | A | 10/1998 | Carter | |
| 5,832,841 | A | 11/1998 | Crews et al. | |
| 5,881,652 | A | 3/1999 | Besaw | |
| D412,253 | S | 7/1999 | Brozak, Jr. | |
| 5,918,744 | A | 7/1999 | Bringard et al. | |
| 5,950,914 | A | 9/1999 | Dunton et al. | |
| 5,980,008 | A | 11/1999 | Stoever | |
| 5,996,366 | A | 12/1999 | Renard | |
| 5,996,510 | A | 12/1999 | Harpman et al. | |
| D419,275 | S | 1/2000 | Carter | |
| D419,744 | S | 1/2000 | Carter | |
| 6,012,399 | A | 1/2000 | Carter | |
| 6,070,726 | A | 6/2000 | Graham | |
| 6,076,475 | A | 6/2000 | Kuhn et al. | |
| D428,738 | S | 8/2000 | Brozak, Jr. | |
| 6,126,131 | A | 10/2000 | Tietz | |
| 6,135,030 | A | 10/2000 | Besaw | |
| D433,782 | S | 11/2000 | Carter | |
| D433,839 | S | 11/2000 | Culbertson | |
| 6,145,671 | A | 11/2000 | Riga et al. | |
| 6,164,215 | A | 12/2000 | Cook et al. | |
| 6,189,778 | B1 | 2/2001 | Kanter | |
| D453,057 | S | 1/2002 | Sewell | |
| 6,354,229 | B1 | 3/2002 | Heidtke | |
| 6,394,003 | B1 | 5/2002 | Lacy, III | |
| D461,334 | S | 8/2002 | Johnson et al. | |
| D464,498 | S | 10/2002 | Riga et al. | |
| 6,510,982 | B2 | 1/2003 | White et al. | |
| 6,585,118 | B2 | 7/2003 | Kellogg | |
| 6,612,247 | B1 | 9/2003 | Pistner et al. | |
| 6,659,295 | B1 | 12/2003 | De Land et al. | |
| 6,729,484 | B2 | 5/2004 | Sparkowski | |
| 6,769,368 | B2 | 8/2004 | Underbrink et al. | |
| D495,901 | S | 9/2004 | Bosman | |
| 6,814,245 | B2 | 11/2004 | Leclerc et al. | |
| 6,905,021 | B2 | 6/2005 | Polumbaum et al. | |
| D509,382 | S | 9/2005 | Raile | |
| 6,951,300 | B2 | 10/2005 | Caille et al. | |
| D521,275 | S | 5/2006 | Dusenberry | |
| 7,036,196 | B2 | 5/2006 | Salatin et al. | |
| 7,066,380 | B2 | 6/2006 | Blake | |
| 7,089,872 | B2 | 8/2006 | Wintermute, II et al. | |
| D533,734 | S | 12/2006 | Campbell | |
| 7,191,906 | B1 | 3/2007 | Pinco | |
| 7,234,604 | B2 | 6/2007 | Eisele | |
| D566,989 | S | 4/2008 | Mason | |
| D576,426 | S | 9/2008 | Yuen-Schat et al. | |
| D578,804 | S | 10/2008 | Norman et al. | |
| 7,546,926 | B2 | 6/2009 | Stolle et al. | |
| D603,189 | S | 11/2009 | Raile | |
| 7,650,996 | B2 | 1/2010 | Mark | |
| 7,703,665 | B2 | 4/2010 | McGowan | |
| 7,717,265 | B2 | 5/2010 | Honkawa et al. | |
| 7,726,474 | B2 | 6/2010 | Berger et al. | |
| 7,828,169 | B2 | 11/2010 | Robinson et al. | |
| 7,992,716 | B2 | 8/2011 | Jackson | |
| 8,002,171 | B2 | 8/2011 | Ryan et al. | |
| 8,141,713 | B2 | 3/2012 | Farkas et al. | |
| 2002/0189507 | A1 | 12/2002 | Benner | |
| 2003/0042828 | A1 | 3/2003 | Bonin | |
| 2006/0006096 | A1 | 1/2006 | Funk | |
| 2009/0107940 | A1 | 4/2009 | Norman et al. | |
| 2009/0127150 | A1 | 5/2009 | Meers | |
| 2011/0000955 | A1 | 1/2011 | Manteufel et al. | |
| 2011/0049072 | A1 | 3/2011 | Dewhurst | |
| 2012/0074037 | A1 * | 3/2012 | Orischak et al. | 206/736 |

* cited by examiner

CONTAINER WITH KICK-BACK

CROSS-REFERENCE TO RELATED APPLICATIONS

The present application claims the benefit of U.S. Provisional Application No. 61/479,717 filed Apr. 27, 2011, the contents of which are incorporated herein by reference.

FEDERALLY SPONSORED RESEARCH OR DEVELOPMENT

N/A

FIELD OF THE INVENTION

The present invention generally relates to a container or box having an inner carton and an outer carton for transporting and displaying goods, the cartons provided with extensions that act as spacers in the interior of the container.

DESCRIPTION OF THE PRIOR ART

A large variety of containers or boxes are used to ship goods. The present invention provides a box that also converts to a display for the product contained in the box, eliminating the need to remove the product and place it in a separate display.

SUMMARY OF THE INVENTION

The present invention provides a container or box having an easy to use machine-assembled structure featuring paperboard and corrugated substrates. It has a sharpless design that eliminates knives in the manufacturing process. The box includes a glued-in kick-back feature to optimally merchandise product transported in the box on-shelf. A top minor back flap features added material that succinctly folds down to fill headspace void and firmly hold product in place for superior protection.

The box meets retailers supply chain requirements. The box also offers exceptional brand billboard to help generate additional sales on-shelf.

The box includes an efficient design that can be engineered to run in-line on automated fill equipment. It has a full overlap design that provides optimal stacking strength. The box also includes an inner carton that forms an inner tray designed for increased product visibility and easy access.

In accordance with one embodiment, a box for shipping and displaying goods is provided. The box comprises an inner carton having front panel, a first side panel, a second side panel, a back wall panel, and a plurality of bottom wall panels forming a bottom of the box. Additionally, one of the bottom wall panels includes a first spacer for occupying space in the interior of the container or box. The first spacer can be extra material in the flap configured to be folded to occupy free space in the box or apply pressure to the goods therein (in order to avoid movement of the goods during shipping). The box further comprises an outer carton having front panel, a first side panel, a second side panel, a back wall panel, and a plurality of top wall panels form a top of the box. One of the top wall panels includes a second spacer for occupying space in the interior of the container or box. Similar to the first spacer, the second spacer can be extra material in the flap which can be folded to occupy free space in the box or apply pressure to the goods therein. The inner and outer cartons are configured to fit together to form the box.

The outer carton of the box also comprises a first removable flap and a second removable flap. The first removable flap of the outer carton is positioned along a mid-portion of a first side of the front panel and along the first side panel, and the second removable flap of the outer carton is positioned along a mid-portion of a second side of the front panel and along the second side panel.

The inner carton can also comprises a first removable flap generally aligned with the first removable flap of the outer carton, and a second removable flap generally aligned with the second removable flap of the outer carton. Both sets of flaps are removed to display the goods.

The inner carton is formed from a single blank of material. Similarly, the outer carton is also formed from a single blank of material.

The outer carton is removably attached to the inner carton. This can be accomplished by connecting flaps on the inner carton to flaps on the outer carton. Alternatively, at least a portion of the front panel of the outer carton is removably connected. Similarly, at least a portion of the top panel of the outer carton is removably connected. For display, a portion of the front panel and top panel of the outer carton are removed to show the product. Additionally, at least a portion of the first side panel can be removably connected and at least a portion of the second side panel can be removably connected to enhance the look of the box and goods during display. Perforations can be used to enable removal of these portions.

The first side panel of the inner carton can includes a cut-away portion. Similarly, the second side panel of the inner carton includes a cut-away portion. The cut-away portions can also enhance the display aspects of the box.

Each of the front panel, first side panel, second side panel and back wall panel of the inner carton can be connected to one of the plurality of bottom wall panels. The first spacer can be connected to the bottom wall panel connected to the back wall panel of the inner carton.

Each of the front panel, first side panel, second side panel and back wall panel can be connected to one of the plurality of top wall panels. The second spacer can be connected to the bottom wall panel connected to the front panel of the outer carton.

In accordance with another embodiment, a box for transporting and displaying good comprises an inner carton having a front panel, a first side panel, a second side panel, a back wall panel, and a plurality of bottom wall panels integrally connected and formed from a first blank of material. One of the bottom wall panels includes a first spacer for occupying space in an interior of the container or box. The box also comprises an outer carton having a front panel, a first side panel, a second side panel, a back wall panel, and a plurality of top wall panels integrally connected and formed from a second blank of material. One of the top wall panels of the outer container includes a second spacer for occupying space in the in the interior of the box.

The first spacer can be a foldable extension of one of the bottom wall panels of the inner carton. The second spacer can be a foldable extension of one of the top wall panels of the outer carton.

In accordance with yet another embodiment, a box for transporting and displaying goods comprise a first carton having a front panel, a first side panel, a second side panel, a back wall panel, and a plurality of bottom wall panels integrally connected and formed from a first blank of material. The box also comprises a second carton configured to cooperate with the first carton to form the box. The second carton has a front panel, a first side panel, a second side panel, a back wall panel, and a plurality of top wall panels integrally connected and formed from a second blank of material. One of the first carton and the second carton include a first spacer connected to one of the panels for occupying space in an interior of the box.

In accordance with one configuration, the first spacer is on the first carton. In this configuration, the second carton can include a second spacer connected to one of the panels in the second carton for occupying space in the interior of the box.

Further aspects of the invention are disclosed in the description of the invention, including the Figures and/or Attachments.

BRIEF DESCRIPTION OF THE DRAWINGS

To understand the present invention, it will now be described by way of example, with reference to the accompanying drawings in which.

DETAILED DESCRIPTION

Figure 2:
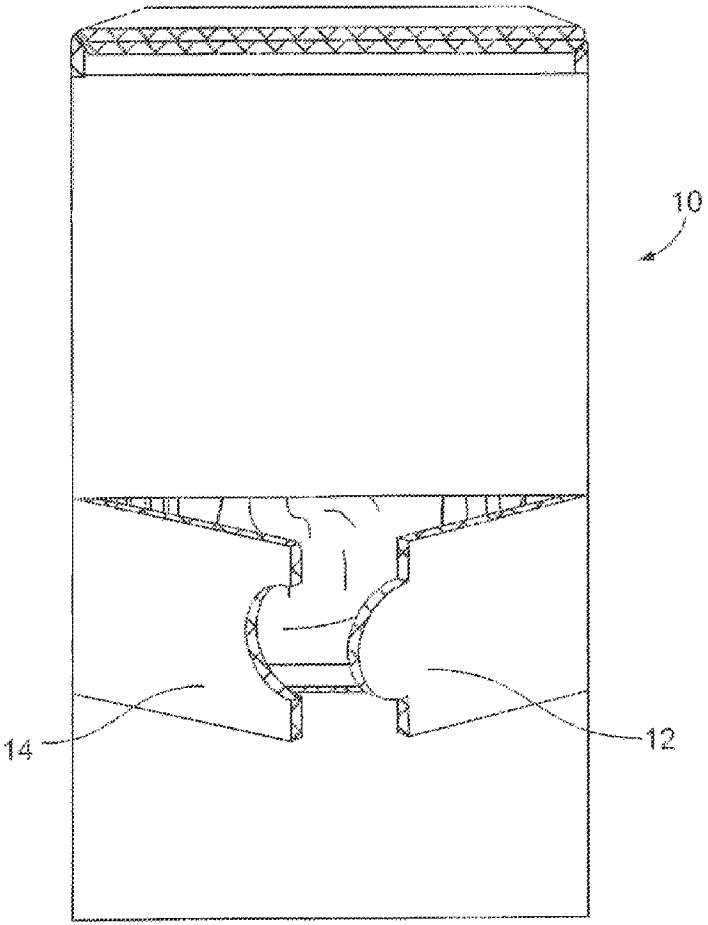
FIG. 2 is a photograph of the box of FIG. 1 with two opening panels of the outer carton and the inner carton in a partially opened position.
Figure 1:
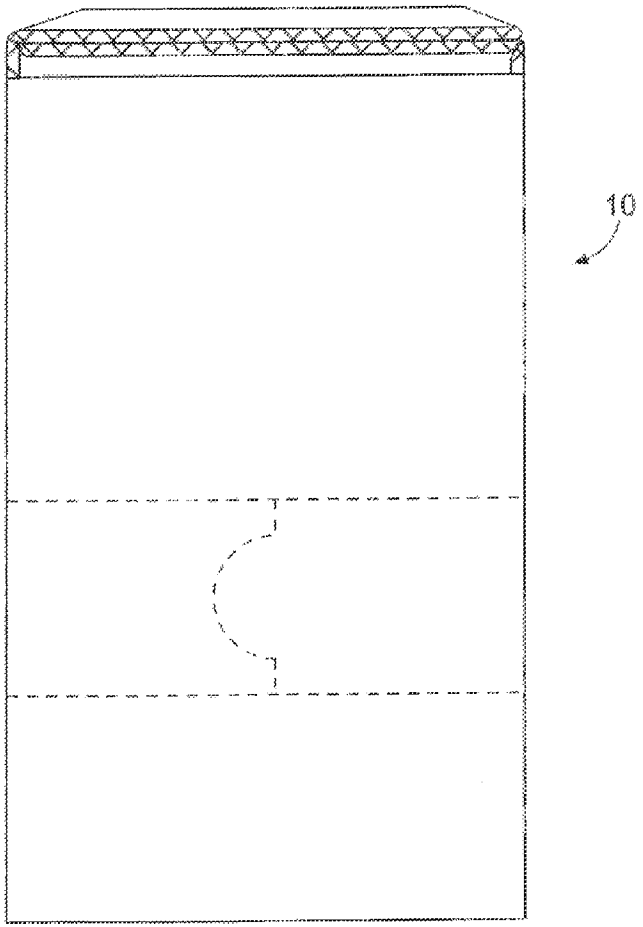
FIG. 1 is a photograph of a box having an inner carton and an outer carton in an unopened state in accordance with the present invention.

While this invention is susceptible of embodiments in many different forms, there is shown in the drawings will herein be described in detail preferred embodiments of the invention with the understanding that the present disclosure is to be considered as an exemplification of the principles of the invention and is not intended to limit the broad aspect of the invention to the embodiments illustrated.

FIGS. 1-5 disclose a box 10 for transporting and displaying goods in accordance with the present invention. During transportation, the box 10 has a generally rectangular outer shape. After transport, the box can be opened and utilized as a display system.

Specifically, after the box 10 is shipped (e.g., to a store), portions of the box 10 can be removed to turn the box into a display system containing the goods shipped. Referring to FIG. 2, the box 10 includes a first opening flap 12 and a second opening flap 14. The flaps 12 and 14 are shown partially opened and connected to the remainder of the box 10. The flaps 12, 14 are positioned in the middle of a front facing panel 24.

Figure 3:
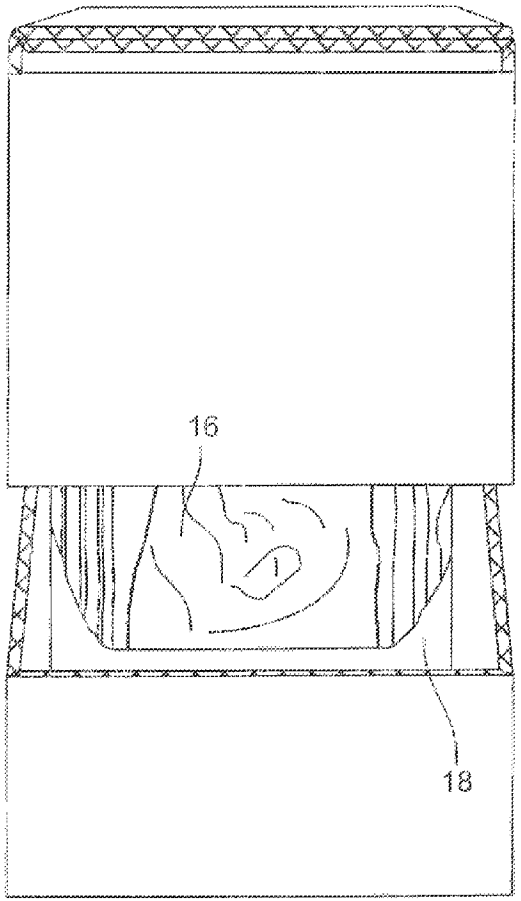
FIG. 3 is a photograph of the box of FIGS. 1 and 2 with the two opening panels of the outer carton removed as well as two opening panels of the inner carton.

FIG. 3 shows the box 10 of FIG. 2 with the flaps 12, 14 removed from the box 10. Goods 16 (in this instance, foil covered packages) held in an inner carton 18 of the box 10 are visible through the opening exposed by the removed flaps 12, 14 (and removed flaps from the inner carton as discussed below). The inner carton 18 is positioned substantially within an outer carton 19, and cooperates with the outer carton 19 to form the box 10.

Figure 4:
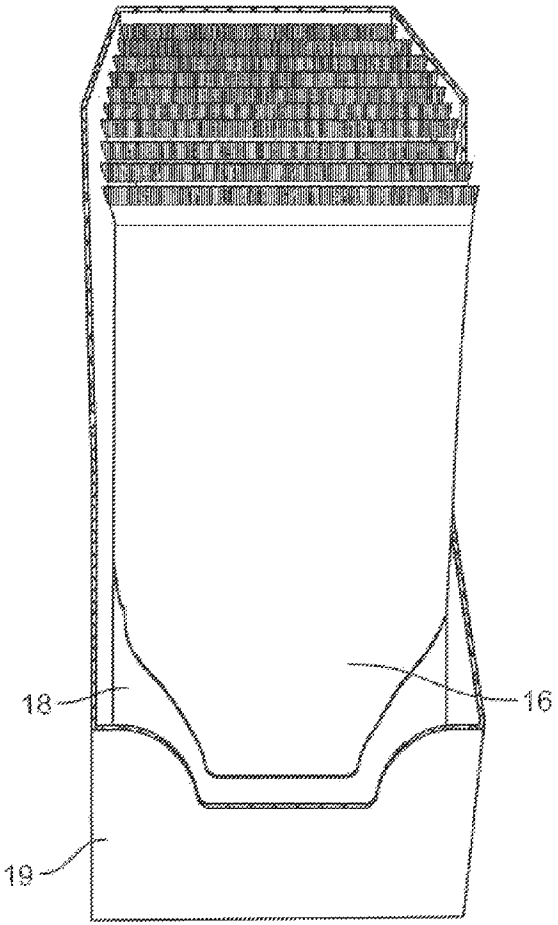
FIG. 4 is a photograph of the box of FIGS. 1-3 with a top portion removed exposing product.
Figure 5:
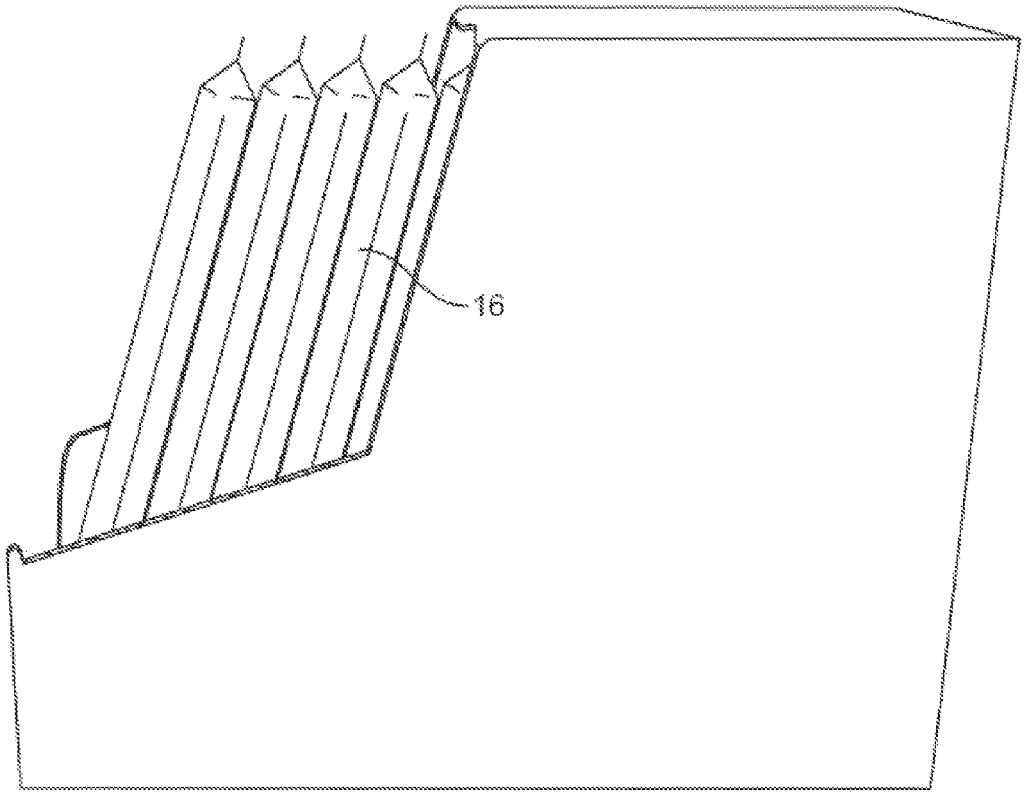
FIG. 5 is a photograph of the box of FIG. 4 from one side of the box.

FIGS. 4 and 5 show the box 10 with the outer carton removed. Based on the shape of the inner carton, this fully exposes the goods 16 for sale.

Figure 6:
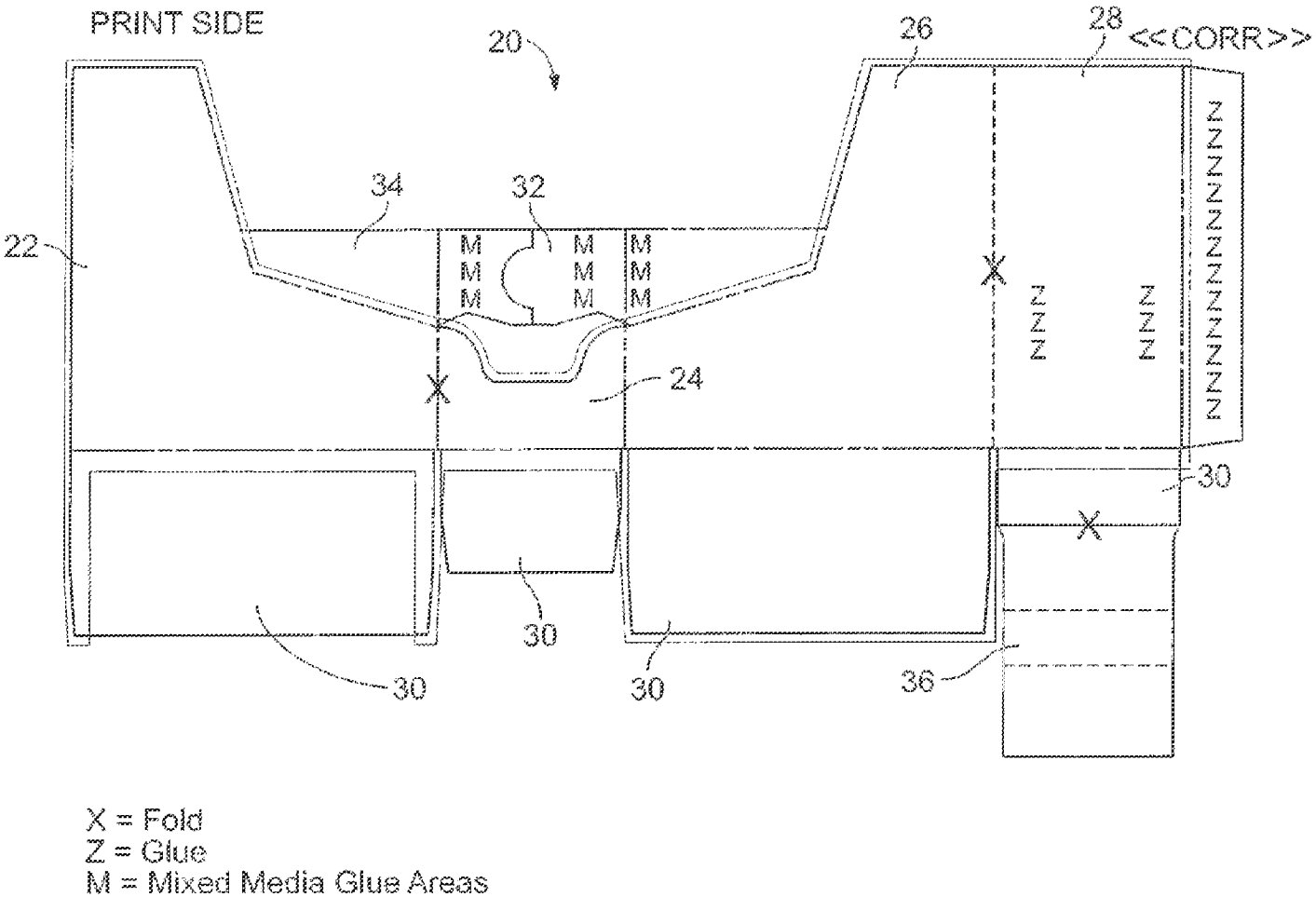
FIG. 6 is a blank of an inner carton in accordance with the present invention; and, FIG. 7 is a blank of an outer carton in accordance with the present invention.

FIG. 6 discloses a blank 20 for forming the inner carton 18 of the box 10. The blank 20 includes a first side panel 22 connected to one side of a front panel 24. A second side panel 26 is connected on a first side to a second side of the front panel 24, and a back wall panel 28 is connected to a second side of the second side panel 26. Bottom flaps or panels 30 extend from a lower portion of each of the first side panel 22, front panel 24, second side panel 26 and back panel 28. The bottom panels 30 connected to the side, front and back panels of the inner carton 18 form a bottom of the box 10.

The blank 20 for the inner carton 18 also includes a first opening flap 32 and a second opening flap 34 that correspond substantially in shape and position to the opening flaps 12 and 14. The opening flaps 32, 34 of the inner carton 18 are connected to (e.g., by glue) and are removed along with the opening flaps 12, 14 of the outer carton when opening the box 10. This connection between the flaps of the outer carton and the inner carton facilitates keeping the inner carton and the outer carton together to act as a single box for transporting the goods. Once the flaps are removed, the inner carton can be separated from the outer carton.

One of the bottom panels 30 (connected to the back wall panel 28) is provided with an extension portion 36 which acts as a spacer in the interior of the box during use. The extension portion 36 can be folded and positioned in the interior of the box 10 to fill unused space in the interior of the box and help support the goods being transported (e.g., prevent the goods from shifting or moving in the box 10). The extension keeps the goods together and prevents them from too much movement in the box during transportation.

Figure 7:
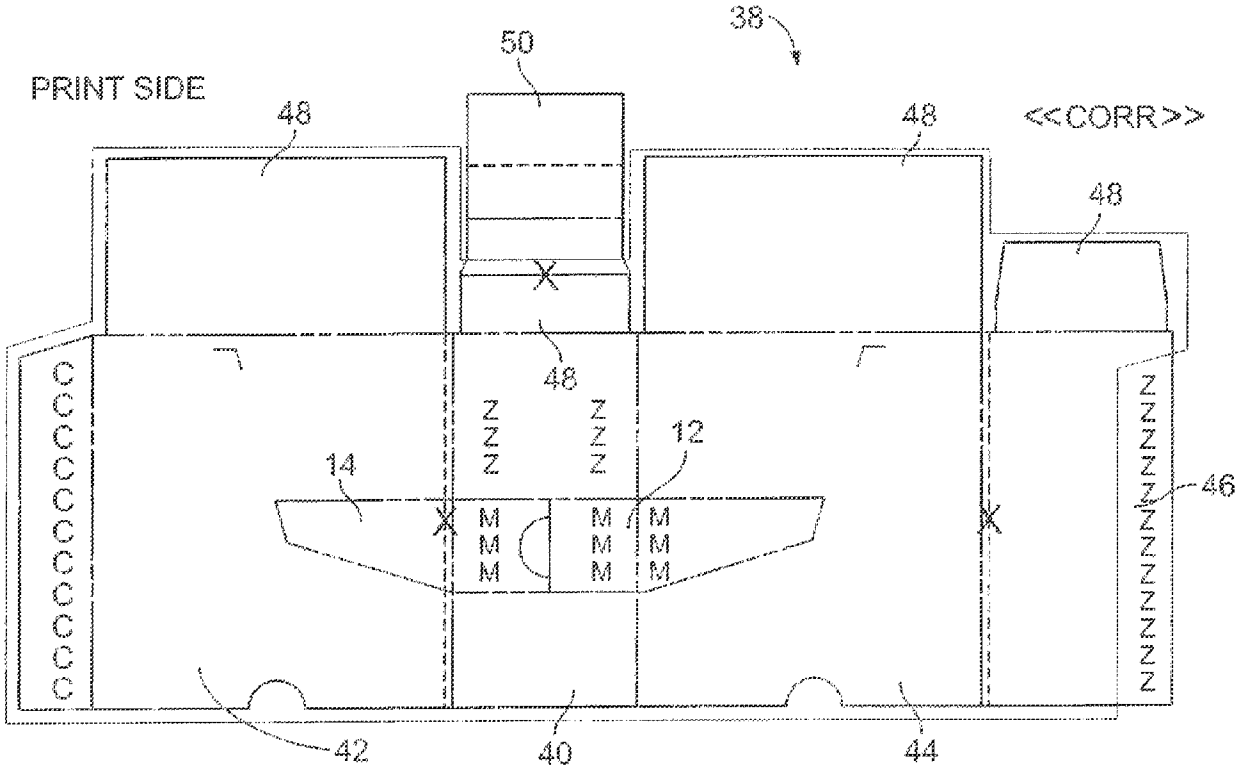

FIG. 7 discloses a blank 38 for forming the outer carton 19 of the box 10. The blank 38 includes a front panel 40, a first side panel 42 connected on to the front panel 40 on a first side and a second side panel 44 connected on a first side to a second side of the front panel 40. A back wall panel 46 is connected to a second side of the second side panel 46. Each of the front panel 40, first side panel 42, second side panel 44 and back wall panel 46 include a top flap or panel 48 which cooperate to form a top of the box 10. The opening flaps 12 and 14 are formed in the front panel 40 and the first and second side panels 44, 46.

Similar to the inner carton blank 20, the blank 38 for the outer carton has an extension portion 50 on the top flap 48 connected to the front panel 40. Again, the extension portion acts as a spacer in that it can be folded and positioned in the interior of the box 10 to take up space and support the goods contained therein.

Each component of the box 10, i.e., the inner carton 18 and the outer carton 19, is provided with appropriate fold lines and perforations to enable folding and/or (later) removal of components to create the box 10 for transport and display as shown in the Figures. The cartons 18, 19 can be formed from paperboard or a corrugated material or other similar materials.

While each of the cartons 18, 19 includes an extension portion, it may only be necessary or desired to have one extension portion which can be on either the inner carton 18 or the outer carton 19. Additionally, in some circumstances, the extension portion can be placed on different panels than shown in the Figures. Moreover, in some embodiments, more than one panel of the inner carton 18, or the outer carton 19 can include an extension portion.

In a further embodiment, the outer carton 19 can also include bottom flaps for forming a bottom over the bottom flaps of the inner carton 18.

Many modifications and variations of the present invention are possible in light of the above teachings. It is, therefore, to be understood within the scope of the appended claims the invention may be protected otherwise than as specifically described.

We claim:

1. A box for shipping and displaying goods comprising:

an inner carton having front panel, a first side panel, a second side panel, a back wall panel, and a plurality of bottom wall panels forming a bottom of the box, wherein one of the bottom wall panels includes a first spacer for occupying space in the interior of the box;

an outer carton having front panel, a first side panel, a second side panel, a back wall panel, and a plurality of top wall panels form a top of the box, wherein one of the top wall panels includes a second spacer for occupying space in the interior of the box.

2. The box of claim 1 wherein the outer carton comprises a first removable flap and a second removable flap.

3. The box of claim 1 wherein the first removable flap of the outer carton is positioned along a mid-portion of a first side of the front panel and along the first side panel, and the second removable flap of the outer carton is positioned along a mid-portion of a second side of the front panel and along the second side panel.

4. The box of claim 3 wherein the inner carton comprises a first removable flap generally aligned with the first removable flap of the outer carton, and a second removable flap generally aligned with the second removable flap of the outer carton.

5. The box of claim 1 wherein the inner carton is formed from a single blank of material.

6. The box of claim 3 wherein the outer carton is formed from a single blank of material.

7. The box of claim 1 wherein at least a portion of the front panel of the outer carton is removably connected.

8. The box of claim 7 wherein at least a portion of the top panel of the outer carton is removably connected.

9. The box of claim 1 wherein the outer carton is removably connected to the inner carton.

10. The box of claim 8 wherein the first side panel of the inner carton in includes a cut-away portion, and the second side panel of the inner carton includes a cut-away portion.

11. The box of claim 1 wherein each of the front panel, first side panel, second side panel and back wall panel of the inner carton is connected to one of the plurality of bottom wall panels.

12. The box of claim 11 wherein the first spacer is connected to the bottom wall panel connected to the back wall panel of the inner carton.

13. The box of claim 11 wherein each of the front panel, first side panel, second side panel and back wall panel is connected to one of the plurality of top wall panels.

14. The box of claim 13 wherein the second spacer is connected to the bottom wall panel connected to the front panel of the outer carton.

15. A box for transporting and displaying goods comprising:

an inner carton having a front panel, a first side panel, a second side panel, a back wall panel, and a plurality of bottom wall panels integrally connected and formed from a first blank of material, wherein one of the bottom wall panels includes a first spacer for occupying space in an interior of the box; and, an outer carton having a front panel, a first side panel, a second side panel, a back wall panel, and a plurality of top wall panels integrally connected and formed from a second blank of material.

16. The box of claim 15 wherein one of the top wall panels of the outer carton includes a second spacer for occupying space in the in the interior of the box.

17. The box of claim 15 wherein the first spacer is a foldable extension of the bottom wall panel of the inner carton.

18. The box of claim 16 wherein the second spacer is a foldable extension of the top wall panel of the outer carton.

19. A box for transporting and displaying goods comprising:

a first carton having a front panel, a first side panel, a second side panel, a back wall panel, and a plurality of bottom wall panels integrally connected and formed from a first blank of material, and, a second carton configured to cooperate with the first carton to form the box, the second carton having a front panel, a first side panel, a second side panel, a back wall panel, and a plurality of top wall panels integrally connected and formed from a second blank of material; wherein one of the first carton and the second carton include a first spacer connected to one of the panels for occupying space in an interior of the box.

20. The box of claim 19 wherein the first spacer is on the first carton, and the second carton includes a second spacer connected to one of the panels in the second carton for occupying space in the interior of the box.

* * * * *

UNITED STATES PATENT AND TRADEMARK OFFICE

CERTIFICATE OF CORRECTION

PATENT NO. : 8,827,078 B2
APPLICATION NO. : 13/457835
DATED : September 9, 2014
INVENTOR(S) : Brad Schultz, Jana Doemel and Bevon Dormer It is certified that error appears in the above-identified patent and that said Letters Patent is hereby corrected as shown below:

In the Issued Patent:

In the Brief Description of the Drawings:

At Column 3, lines 19, 22, 25, and 28, delete "photograph" and insert --front view-- therefor;

At Column 3, line 30, delete "photograph" and insert --side view-- therefor;

In the Claims:

At Column 5, line 44, in Claim 10, after "carton" delete "in";

At Column 6, line 25, in Claim 16, after "the" delete "in the".

Signed and Sealed this
Thirtieth Day of December, 2014

Michelle K. Lee

Michelle K. Lee
*Deputy Director of the United States Patent and Trademark Office*